US006276612B1

(12) United States Patent
Hall

(10) Patent No.: US 6,276,612 B1
(45) Date of Patent: Aug. 21, 2001

(54) SYNCHRONIZED FOUNTAIN AND METHOD

(76) Inventor: Scott Hall, 5500 NW. 22nd Ave., Ft. Lauderdale, FL (US) 33309

( * ) Notice: Subject to any disclaimer, the term of this patent is extended or adjusted under 35 U.S.C. 154(b) by 0 days.

(21) Appl. No.: 09/566,840

(22) Filed: May 5, 2000

(51) Int. Cl.[7] ..... B05B 17/08

(52) U.S. Cl. ..... 239/17; 239/16; 239/18; 239/20; 239/23; 239/99; 239/101

(58) Field of Search ..... 239/16, 17, 18, 239/20, 22, 23, 67, 69, 99, 101

(56) References Cited

U.S. PATENT DOCUMENTS

| | | | | |
|---|---|---|---|---|
| 1,977,997 | | 10/1934 | Patterson . | |
| 2,787,495 | * | 4/1957 | Przystawik | 239/17 |
| 2,868,055 | | 1/1959 | Simos . | |
| 3,165,966 | * | 1/1965 | Pribyl | 239/17 |
| 3,294,322 | * | 12/1966 | Kawamura et al. | 239/17 |
| 3,907,204 | | 9/1975 | Przystawik . | |
| 4,305,117 | | 12/1981 | Evans . | |
| 4,376,404 | | 3/1983 | Haddad . | |
| 4,844,341 | | 7/1989 | Alba . | |
| 5,069,387 | | 12/1991 | Alba . | |
| 5,152,210 | | 10/1992 | Chen . | |
| 5,439,170 | | 8/1995 | Dach . | |

* cited by examiner

*Primary Examiner*—David A. Scherbel
*Assistant Examiner*—Robin O. Evans
(74) *Attorney, Agent, or Firm*—Brinkley, McNerney, Morgan, Solomon & Tatum, LLP

(57) ABSTRACT

A fountain control system capable of synchronizing a water, light, and sound performance. The fountain control system includes a plurality of variable speed pumps which are used to control the flow of water through the discharge conduits and ultimately the height of the stream of water projected by the discharge outlet. The fountain control system is capable of varying the speed of the pumps in accordance with an audio input signal and thereby control the height of the stream of water without the use of valves. The light and sound aspects of the performance are delayed to compensate for mechanical delays in the system to ensure a synchronized performance. The fountain control system has the added ability of providing a unique performance based on different pieces of music without the need of reprogramming.

16 Claims, 8 Drawing Sheets

SYNCHRONIZED FOUNTAIN AND METHOD

BACKGROUND OF THE INVENTION

1. Field of the Invention

This invention relates to decorative water fountains which incorporate the use of such things as lighting and sound features, and in particular relates to systems, methods and apparatuses for infinitely varying the water output of the fountain and the lighting effect in correspondence with audio or other signals in real time.

2. Background Art

For centuries, fountains have been used to bring life to landscape and architecture. In more recent times, lighting and sound features have been added to enhance the artistic appeal of fountains. Attempts at coordinating the water, light and sound outputs so as to create a cohesive and unified audio/visual effect have either met with failure or have proven to be so labor intensive and costly as to be unfeasible to all but the most pecunious fountain owners. The inventor is unaware of any systematic fountain apparatus which can vary the water and light output of a fountain in a coordinated manner as a function of sound (e.g. music) input signals in real time regardless of the nature, frequency, beat, etc. of the sound input signals. All previous attempts at real time control of water and light output in response to audio signal input have required the creation of software routines customized to the particular piece of music.

One attempt at providing a controlled fountain in which the water and light outputs are varied in accordance with musical sounds is disclosed in U.S. Pat. No. 5,439,170 to Dach. Dach includes valves which are positioned downstream from water pumps, which valves are opened and closed to retard or permit water to flow to output jets. Attempting to control valves in this way will inevitably lead to undesired inertia losses and undue overall complexity in such a system, which will make it virtually impossible to obtain a truly synchronized output of water, light and sound.

Another attempt at providing a fountain in which water output and light emission is varied in accordance with input signals related to audio sounds is U.S. Pat. No. 5,152,210 to Chen. The Chen system operates in three discrete settings: a built-in procedure setting in which a main circuit provides predetermined signal sets to control the water and light performance sub-systems in a predetermined manner; an external sound input mode in which the main unit receives an analog signal which is analyzed and applied to a corresponding set of statistical music theory rules; and an external specific signal mode about which no detail is given. As in the patent to Dach, independent valves downstream of the water pumps are used to control water flow through the array of jets making up the fountain. Further, the valves which control water flow utilize photo interrupters to control valve position and hence water outlet selection.

A still further attempt at providing a fountain having variable operating states is disclosed in U.S. Pat. No. 5,069,387 to Alba. The Alba patent discloses a fountain controlled by a microprocessor, the output of the fountain being variable through the microprocessor in accordance with such parameters as input music signals. However, like the aforementioned references, the water flow is regulated by valves positioned downstream of the flow pumps and, consequently, suffer from the disadvantages already mentioned. In addition, the Alba fountain, although being extremely precise, is extremely complicated in that each water outlet constituting a jet making up the array of possible outlets are individually controlled by a valve residing within and constituting a part of the jet itself. The larger the fountain, the larger the complications incident to varying the pattern(s). In addition, installation of complicated electro-mechanical valves at each jet would essentially prohibit such a fountain from being used as a floating fountain due to size and weight limitations.

SUMMARY OF THE INVENTION

The shortcomings inherent in the above-described disclosures, and others, are overcome by the instant apparatus, system and method of use wherein input audio signals of any type are fed to a microprocessor which converts the incoming audio signal to real-time control commands for fountain pumps and fountain lighting, and wherein the water output of any given circuit in the fountain is varied by changing the speed of the pump, without depending upon the opening or closing of any valves whatsoever. In this way, much greater versatility is permitted in the design and function of fountain systems of this type.

In its simplest form, the system includes a sound receiving or generating apparatus such as a radio or CD-player, the timing and settings of which can be manual or automated, a digital crossover unit to separate the audio signal into high, medium and low frequency band, an AC-DC converter to convert the separated AC audio signals into amplified usable DC computer inputs for processing, and a microprocessor, preferably in the form of a programmable logic controller, to process the incoming signals from the converter and output real time control commands for the fountain pumps and lighting control circuit(s). The system takes into account delays in water output occasioned by inertia, so that the sound, light and water features of the system are accurately coordinated.

The programmable logic controller can also be programmed to control start-up or discontinuance of the system, musical selections, and the times at which they are to be played.

In another embodiment, the invention may also use an anonometer which causes the output signal to the fountain pumps to be decreased so as to lower the fountain height, or shut the system down entirely, if wind conditions warrant.

Although there are no limits to the configurations into which an illuminated fountain can be constructed, it is to be appreciated that the instant invention is believed to be best suited to the type in which a plurality of independent water flow circuits are used, each of which terminates in a discharge nozzle array or pattern, the arrays from the various circuits being operated relative to each other in such a way that the desired aesthetic effect is produced. In addition, illumination patterns are incorporated into the fountain so as to dramatically enhance the visual effect produced. Each circuit is supplied with liquid by its own independent pump, the output of which is infinitely variable in dependence upon the control signal received from the microprocessor. The actual control features such as power and switching can vary according to the needs of the application as determined by the designer.

Typically, a control room or "pit" is provided adjacent to the fountain to which a water supply is fed, control components housed, and such things as filtration equipment and sumping apparatus are placed. The water level within the fountain can be regulated by a water level control system, and the illumination control system is preferably positioned there for ease of accessibility when maintenance is required.

The pit should be adequately ventilated, and a forced ventilation system having a minimum of 25 cubic feet of air per minute per horsepower of the system pump is preferred. It is also acceptable, however, to use a natural convection cooling and ventilation system as well known in the art.

The external water supply should coordinate with the water level control system to manually or automatically regulate the water level in the fountain.

A controller is employed to tie together the operation of all systems which make up the fountain. The microprocessor and other control elements of the system may be part of the controller or may be independently housed.

It is, therefore, an object of this invention to provide a decorative water fountain in which illumination and water output levels are varied in real time in accordance with any conceivable input parameters.

It is also an object of this invention to provide an electro-mechanical control system for a fountain display which comprises a plurality of spray systems and light source systems for illuminating the sprays in patterns of color wherein an audio control signal is separated into a plurality of frequency bands, and the output of pumps associated with the spray system(s) is varied on an infinitesimal basis in accordance with a given relationship between the audio signal frequency and pump response(s).

In accordance with these and other objects which will become apparent hereinafter, the instant invention will now be described with particular reference to the accompanying drawings.

DETAILED DESCRIPTION OF THE PREFERRED EMBODIMENT

Figure 1:
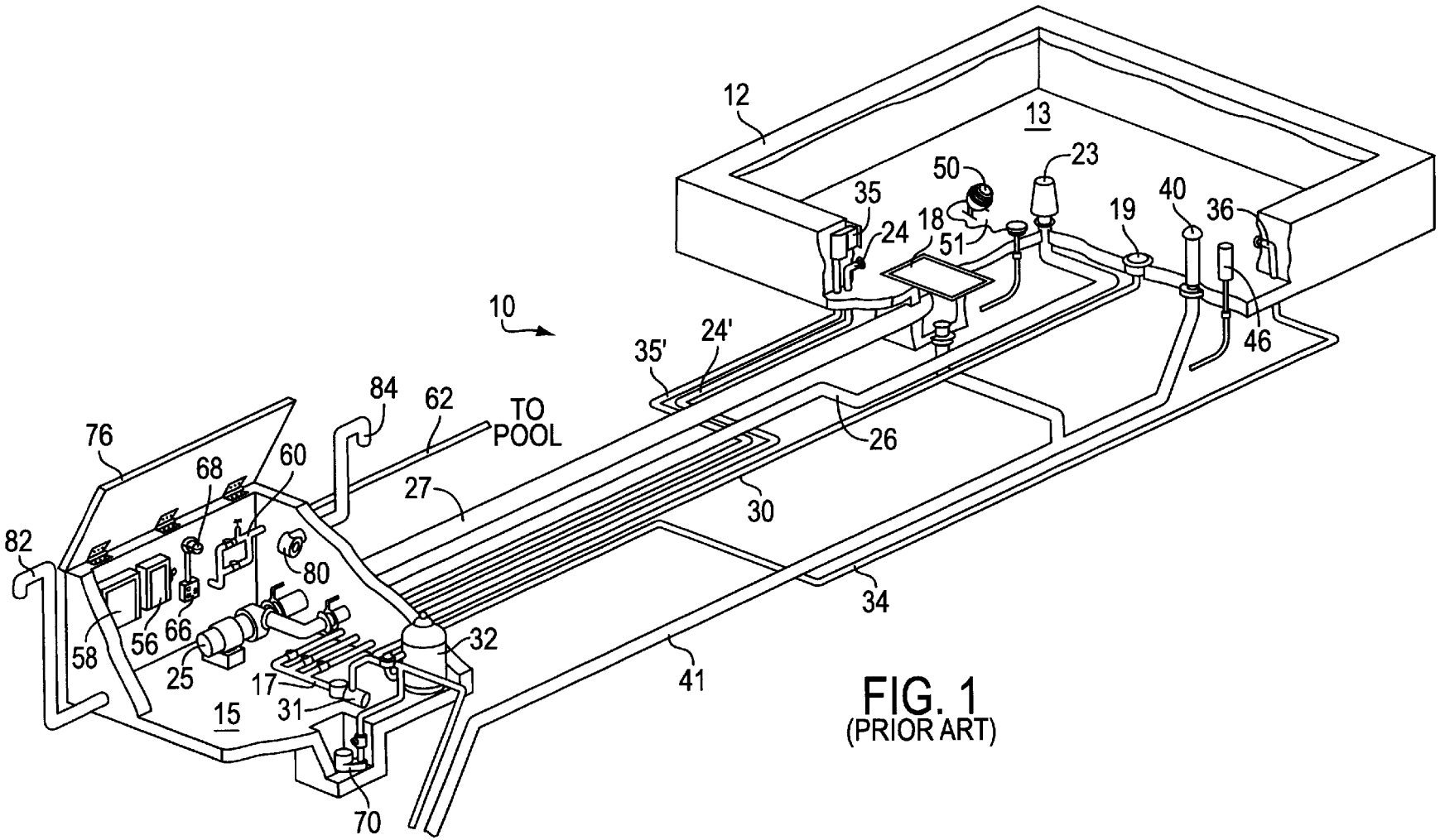
FIG. 1 (PRIOR ART)
FIG. 1 is a perspective, partial cutaway schematic representation of a typical large pool fountain arrangement known in the prior art.

Referring now to the drawings, FIG. 1 illustrates generally a typical prior art fountain wherein a pool 12 is connected to a control room or pit 15 via appropriate electrical and hydraulic apparatus. A fountain jet 23 situated in pool 12 is used to expel a flow of water or other liquid pumped by pump 25 through conduit 26. A drain 18 in the floor 13 of pool 12 allows the water or other liquid expelled through jet 23 to return via return conduit 27 to pump 25 for re-circulation through jet 23. A main drain 19 is used as an intake for filtration system 17. Liquid entering drain 19 flows through conduit 30 into filtration system 17 and is pumped by pump 31 through filter 32 and thereafter conduit 34 through liquid return fitting 36 into pool 12. Ideally, the fitting should be so located as to create a natural circulation of liquid back to filtration skimmer 35 and drains 18 and 19. A vacuum fitting 24 may be employed to connect to a manual cleaning of the pool floor. Vacuum fitting 24 and filtration skimmer 35 are connected filtration system 17 via return conduits 24' and 35', respectively. An overflow drain 40, which has an aperture situated at the desired liquid level within pool 12, is used and drains excess water in pool 12 through drain pipe 41. A plurality of submersible lights 50 for night illumination of fountain features may be employed and are controlled through wiring 51 via controller 58. Controller 58 also is used to regulate other functions of the fountain such as timer clocks for control of the main pump 25, lights and filtration system 17. The controller can also regulate the water level control system, lighting contact doors, sequence timer and any other related controls suited to a particular installation. A light 68 may be used to illuminate pit 15 through electrical box 66. Power outlets may also be employed in electrical box 66 to provide electrical power to equipment, such as power tools and auxiliary lighting, used by those working in the control room. A sump pump 70 may be employed below or at the floor level of pit 15 to drain any undesired water which finds its way into pit 15. A ventilation system may be employed to allow an air flow through the interior of pit 15, particularly when cover 76 is in the closed position over pit 15. To this end, a blower 80 is used to draw outside air through inlet conduit 82 and expel air within pit 15 through outlet conduit 84.

Liquid to replenish the liquid level in pool 12 may be supplied by a municipal water supply system 60 through conduit 62 as needed. A liquid level sensor 46 may be used to measure the liquid level in pool 12 as it drops below a predetermined height. When this occurs, an interconnection between sensor 46 and controller 58 will cause a supply of liquid to be provided to pool 12 via conduit 62. Any suitable control apparatus for maintaining the liquid level in pool 12 is contemplated to be within the scope of the invention.

Pump 25 may be energized by a starter 58, which may be provided with fusible disconnect with overload relays to match the characteristics of pump 25.

Figure 2:
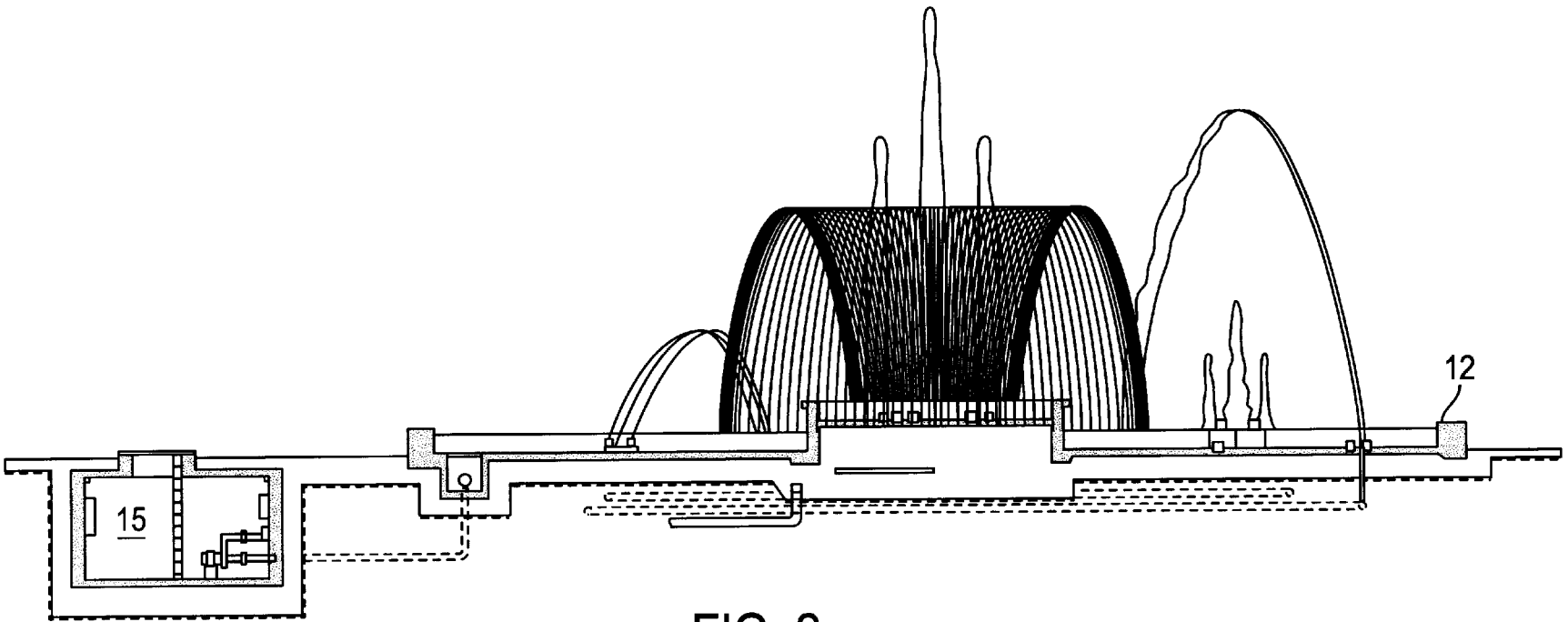
FIG. 2 is a cross-sectional elevational schematic representation of a fountain in accordance with the present invention.

FIG. 2 shows a cross-sectional elevational schematic representation of a fountain in accordance with the present invention. The control room 15 is typically located adjacent to the pool 12. Because access to the control room is not regularly needed, and the addition of a building to house the control room may detract from the aesthetics of the fountain, the control room is typically below ground. A plurality of fountain jets combine to form an artistic collection of water parabolas extending above the pool 12.

Figure 3:
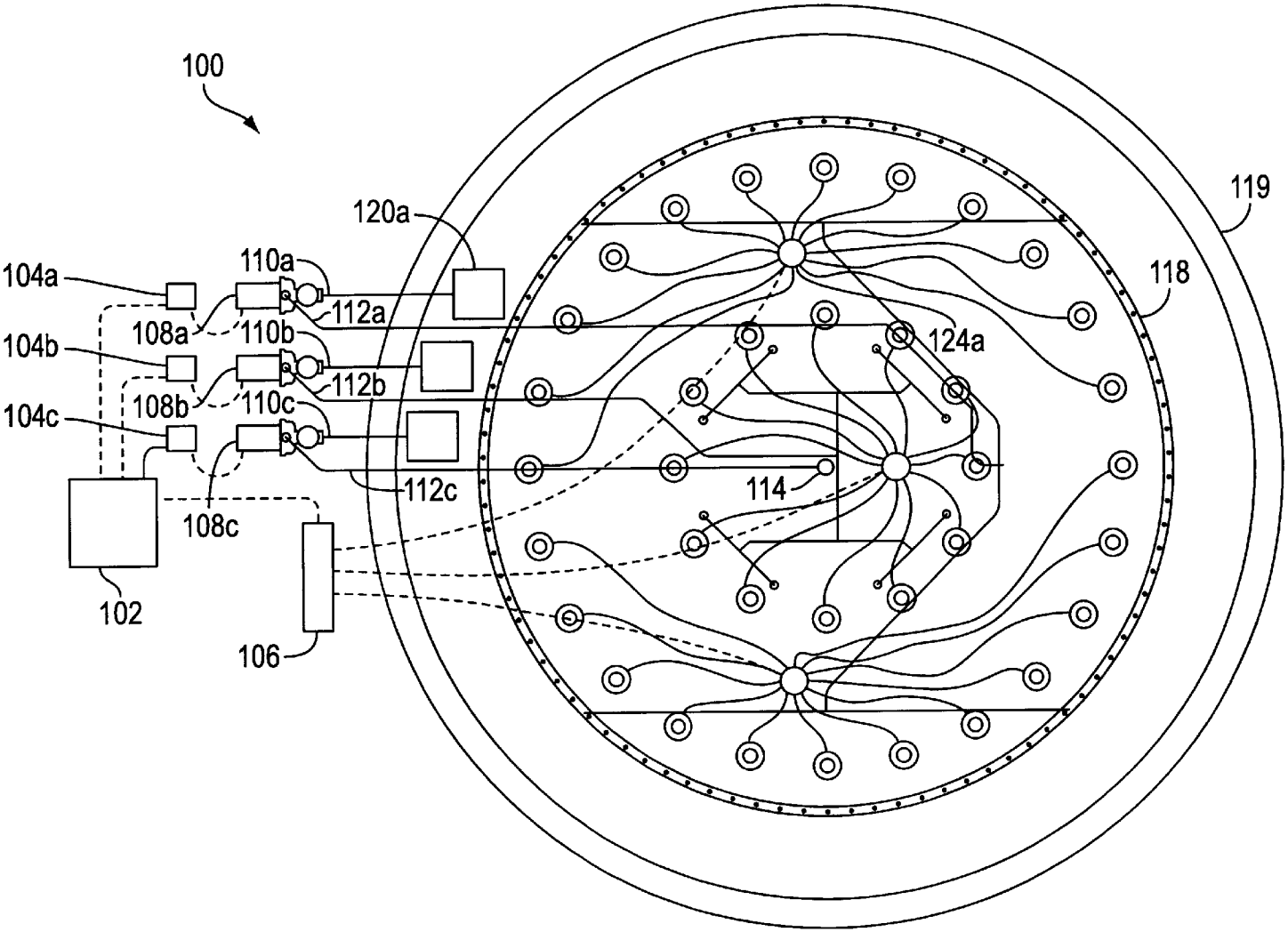
FIG. 3 is a schematic representation of a system according to the present invention shown in plan.
Figure 4:
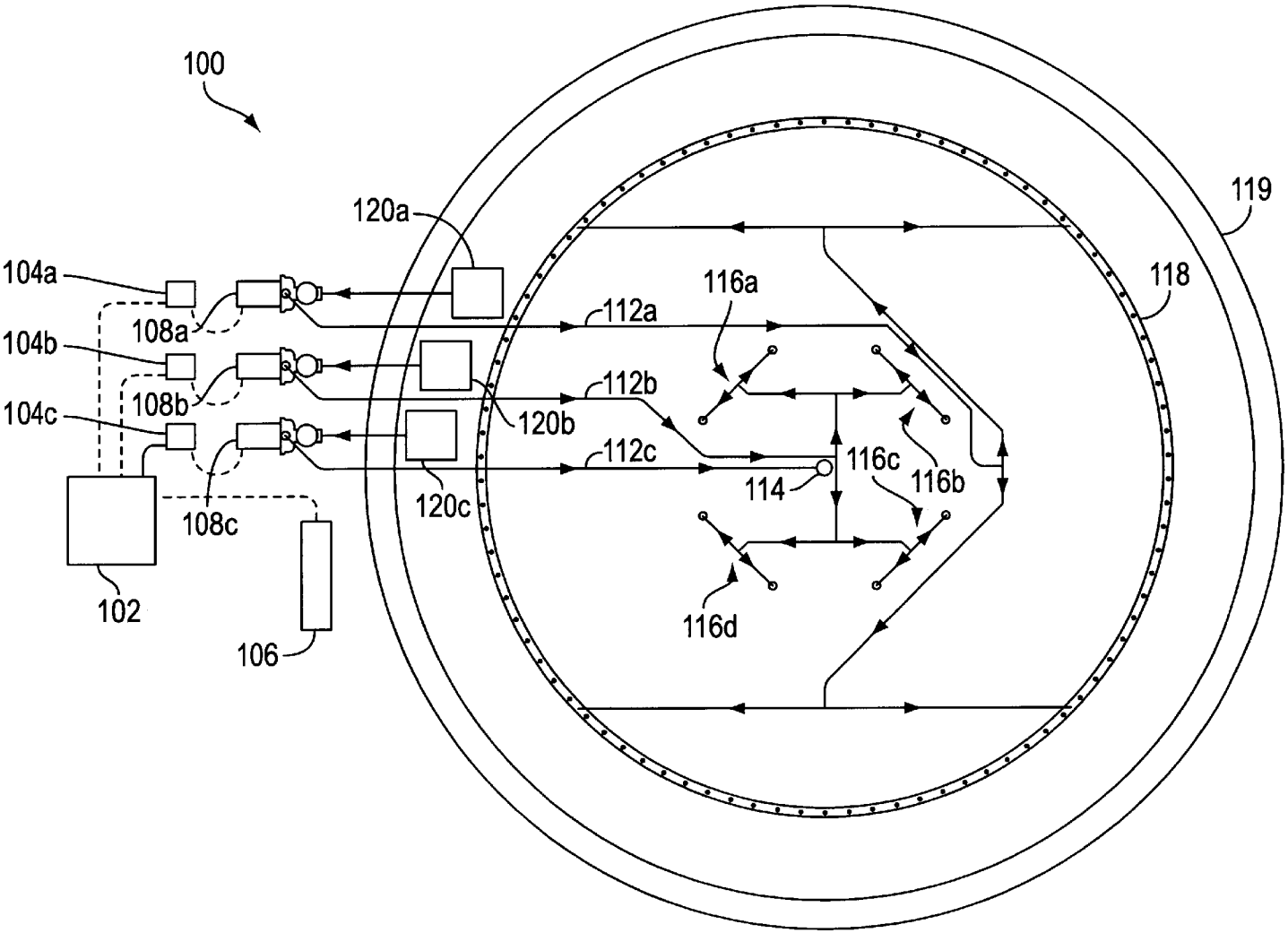
FIG. 4 is a schematic representation of the water pumping system portion of the fountain system shown in FIG. 3.
Figure 5:
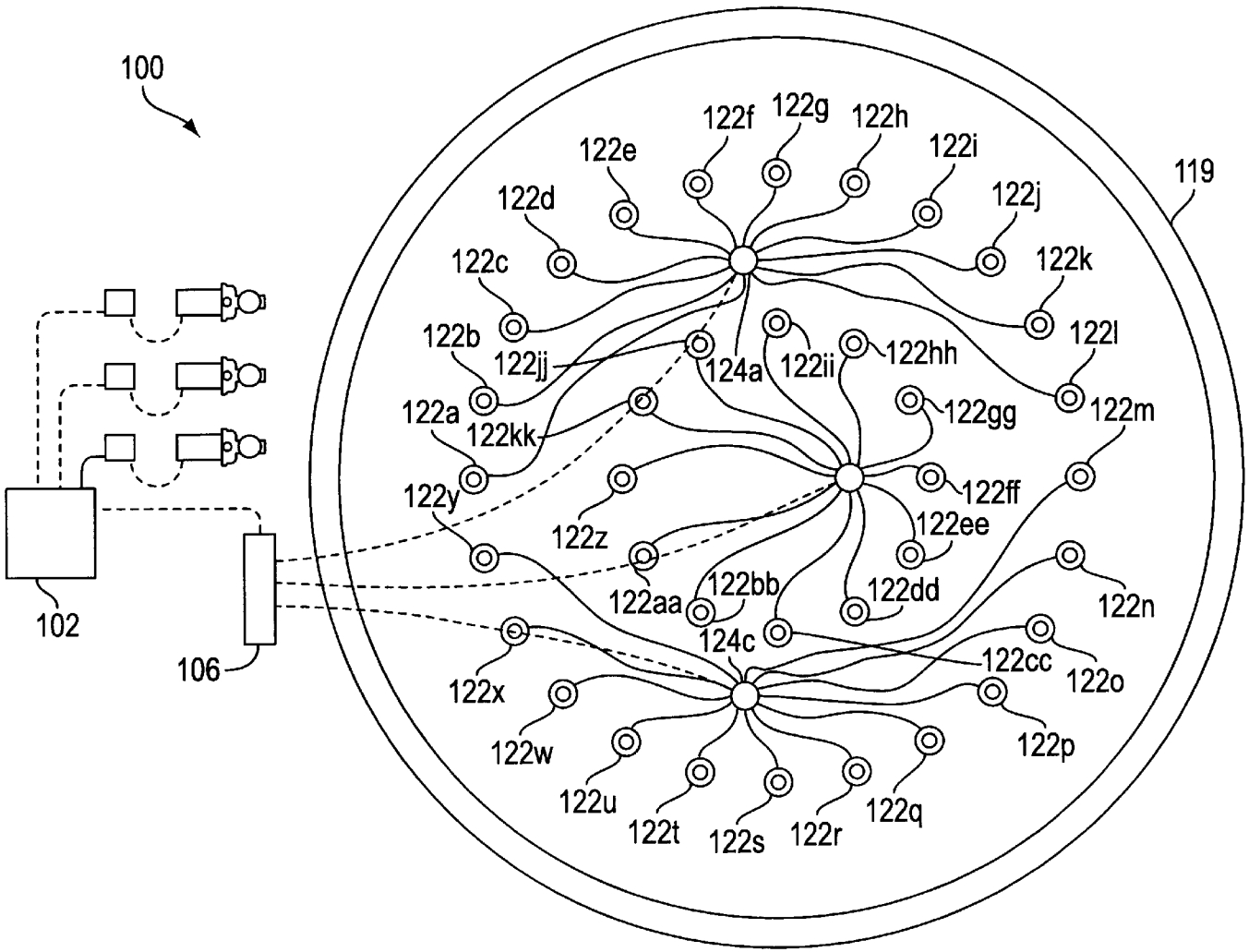
FIG. 5 is a schematic representation of the lighting system portion of the fountain system shown in FIG. 3.

FIG. 3 shows a schematic view of a fountain control system designed in accordance with the present invention. FIG. 4 shows a simplified schematic view of only the pumping elements, while FIG. 5 shows a simplified schematic view of the lighting elements. The fountain control system 100 includes a fountain controller 102 which interfaces to an audio system (not shown), a plurality of motor drives 104*a*, 104*b*, 104*c*, and a light relay panel 106. Fountain controllers are known to the art and utilize a variety of methods to process audio input signals to produce fountain control signals. Modern methods, as used here, utilize a programmable logic controller to process the audio signals to produce a complex visual display of light and water. The complexity of the resulting display can be changed by modifying the program used by the programmable logic controller.

The fountain controller 102 directly controls a plurality of motor drives 104*a*–104*c*. Typically, this direct control is accomplished using electrical connections, but other means, such as radio frequency transmitters and receivers, could also be used. The motor drives 104*a*–104*c* receive control signals from the fountain controller 102 and vary the speed of a water pump 108*a*, 108*b*, 108*c* accordingly. The motor drives 104*a*–104*c* have a variable frequency response which produces various output levels based on the input control level. The motor drives 104*a*–104*c* are each electrically connected to a water pump 108*a*–108*c*. The water pump 108*a*–108*c* is connected to a water intake conduit 110*a*, 110*b*, 110*c* and also to a discharge conduit 112*a*, 112*b*, 112*c*. Water pumps of various designs are know to the art and generally transfer water from the water intake conduit to the discharge conduit. In the preferred embodiment, the water pumps 108*a*–108*c* have an infinitely variable pumping speed, which is controlled by the motor drives 104*a*–104*c*. The variable speed allows the flow through the discharge conduits 112*a*–112*c* to be controlled without the use of valves.

As can be appreciated, each discharge conduit 112*a*–112*c* is attached to at least one discharge outlet 114. The discharge outlets may have various sizes and configurations. For example, the discharge outlets may take the form of a single large discharge nozzle 114, medium sized discharge nozzles used in pairs 116*a*, 116*b*, 116*c*, 116*d*, or a ring with a plurality of small discharge nozzles 118. These are offered as examples of typical configurations known to the to art and are not intended to limit the scope of the disclosure or of the claims herein. Each discharge outlet preferably has a substantially vertical orientation. Typically, the water pumps 108*a*–108*c* draw water through the intake conduits 110*a*–110*c* and force it through the discharge conduits 112*a*–112*c*. The pumped water is then forced though at least one discharge outlet 114, 116*a*–116*d*, 118 which causes a stream of water to be projected through the air. This flow of water is indicated in by the flow lines in FIG. 4. The stream of water follows a parabolic path, which can varied by changing the angle of the discharge nozzle. Preferably, the water lands within a reservoir 119 where it can be once again drawn in through the intake conduits 110*a*–110*c*. The type and angle of the discharge outlets is chosen to achieve a desired artistic effect.

As can be appreciated, the open nature of the reservoir 119 can result in dirt and other debris being introduced into fountain system. Such foreign matter can block the water conduits and otherwise cause the fountain system to malfunction. To prevent foreign matter from entering the system, an intake screen 120*a*, 120*b*, 120*c* is connected to each suction line. The intake screen, which is known to the art, has numerous small apertures which allow water to flow though the screen but prevent objects which are larger than the aperture from flowing through. The intake screen may also employ other filtering materials, such as charcoal, which are known to the art.

A light relay panel 106 is also directly controlled by the fountain controller 102. Typically, this direct control is accomplished using electrical connections, but other means, such as radio frequency transmitters and receivers, could also be used. The relay panel 106 is, in turn, connected to a plurality of substantially vertically oriented light fixtures 122. These connections may be either direct or through a junction box 124*a*, 124*b*, 124*c* for common control of multiple light fixtures. The relay panel 106 varies the intensity of each light fixture 122*a*–122*kk* in accordance with the control signals from the fountain controller. The light and water combine to form a complex, and hopefully artistically pleasing, display.

Figure 6:
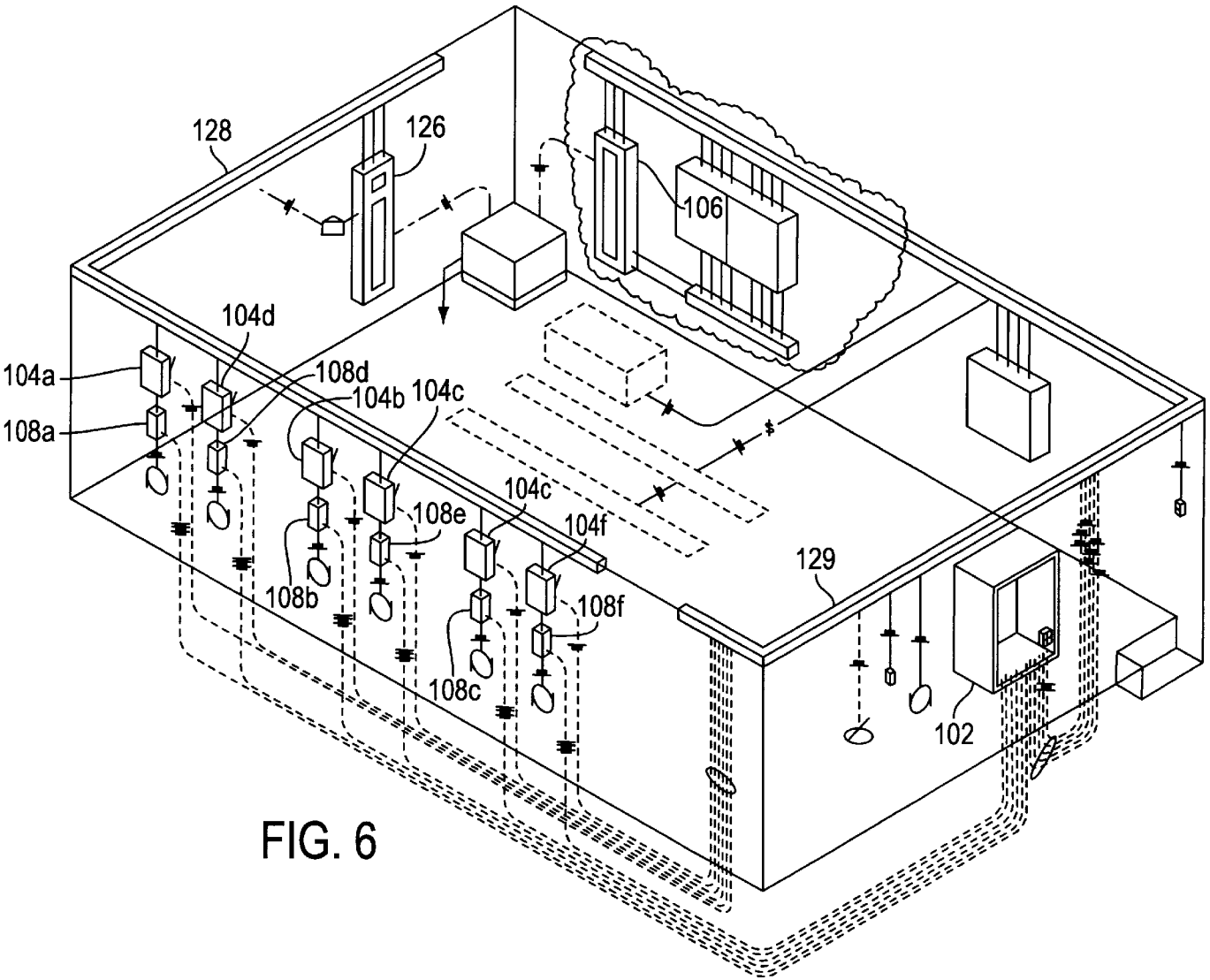
FIG. 6 is a perspective schematic representation of control apparatus which may be used to operate fountains in accordance with the invention.

FIG. 6 shows perspective schematic representation of control apparatus which may be used to operate fountains in accordance with the invention. The motor controls 104*a*–104*c* and water pumps 108*a*–108*c* are preferably mounted to the wall of the control room, as are the fountain controller 102 and light relay panel 106. As can be appreciated, additional motor controllers 104*d*, 104*e*, 104*f*, and water pumps 108*d*, 108*e*, 108*f*, can be added to the fountain system. These additional motor controllers and water pumps can be used to supply additional discharge nozzles or work in tandem with other motor controllers and water pumps to provide a more dramatic effect. One such effect would be to change the number of discharge nozzles activated in relation to the amplitude of the audio input. The power distribution panel 126 provides the electrical interface to the electrical utility company. Wiring conduits 128, 129 are used to carry the electrical supply and control signal wiring. As can be appreciated, centrally locating the electrical components provides ease of maintenance for the end user. It also allows for the lighter elements, namely the light fixtures and discharge nozzles, to be located at a remote location, such as upon a float on a body of water. Variations in the equipment needed and the placement of the equipment depends upon the complexity of the desired fountain system and the physical facilities available.

Figure 7:
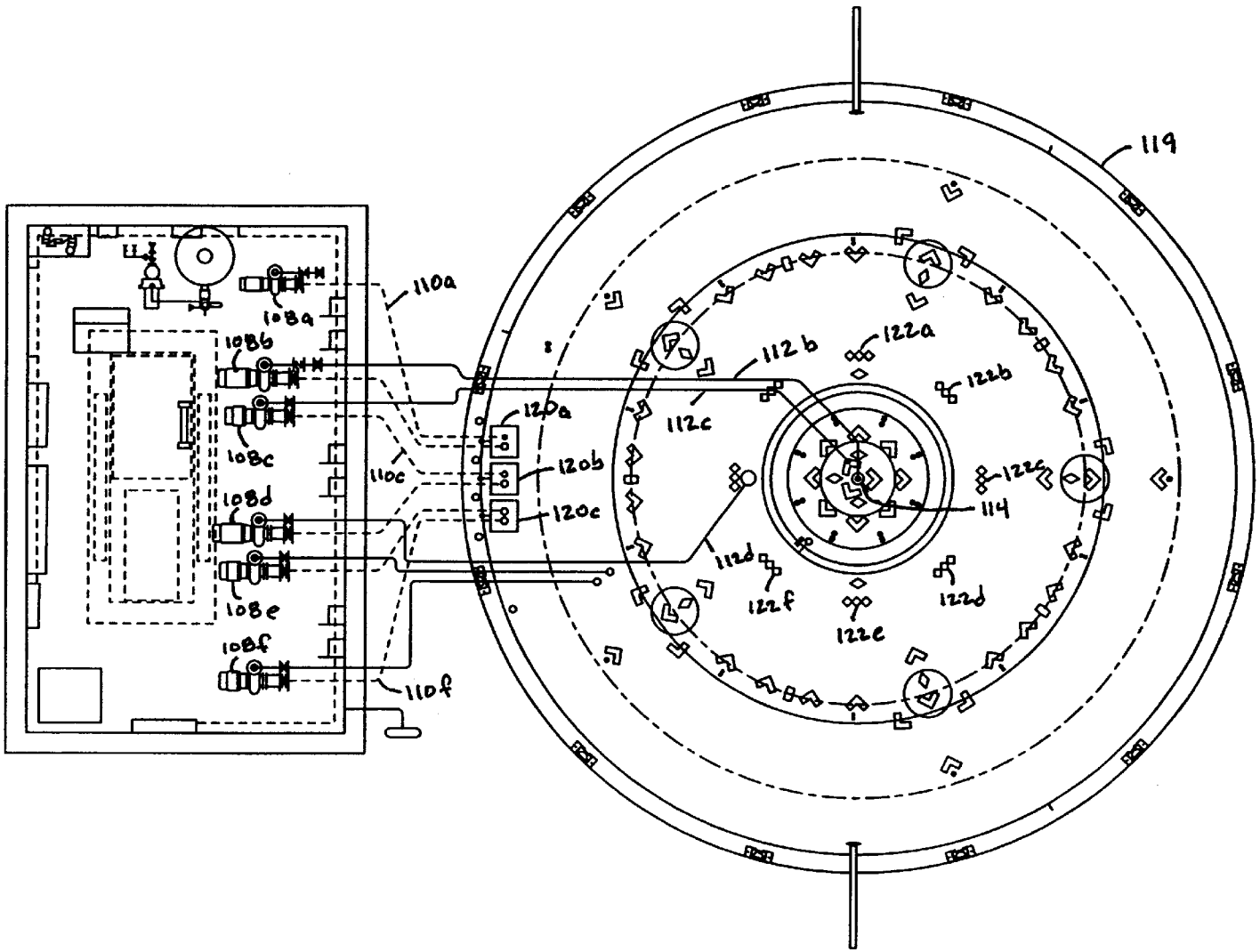
FIG. 7 is a schematic representation of the control and fountain apparatus in accordance with the invention.

FIG. 7 is a schematic representation of the control and fountain apparatus in accordance with the invention.

Figure 8:
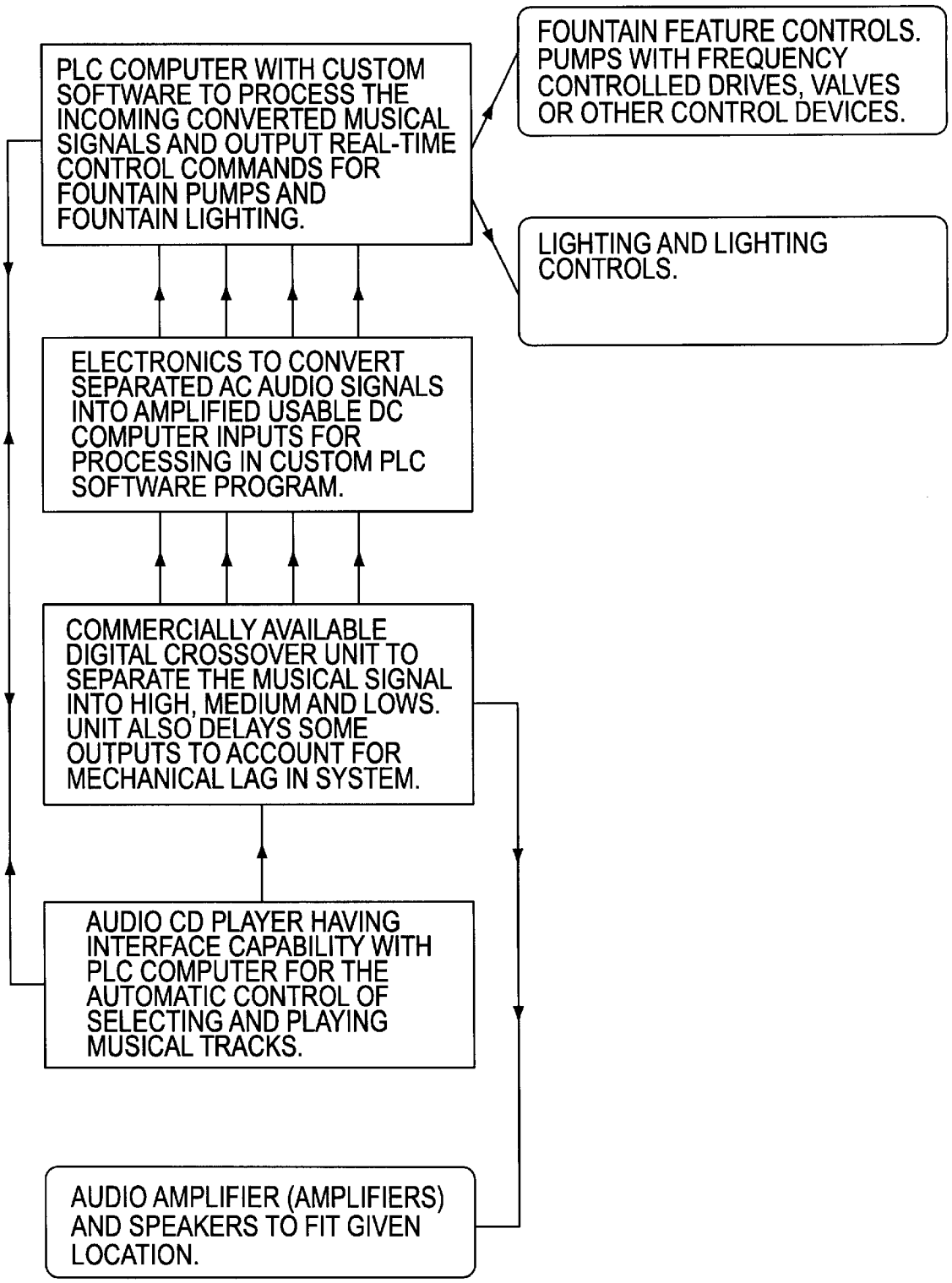
FIG. 8 is a block diagram of a fountain control procedure suitable for use with the invention.

FIG. 8 is a block diagram of a fountain control procedure suitable for use with the invention. The source of audio signals, preferably an audio CD-player, is electrically connected to a digital crossover unit. The crossover unit, which is commercially available and known to the art, separates the audio signals from the CD-player into component frequency ranges for further processing. The crossover unit is also programmed to delay some of the component frequency range outputs to account for mechanical delays elsewhere in the system. In addition, the control signals to the light relay panel and the audio signal to the speakers is also delayed to allow the desired changes in the water flow to take effect.

The output signals from the crossover unit are fed into a bank of A/D converters. The A/D converters convert the analog audio signals into digital signals which are then amplified before being processed by the programmable logic controller to produce the control signals for the motor drives and light relay panel.

A significant advantage to this system over the prior art is the musically-independent nature of the program. The program is customized in relation to the physical characteristics of the fountain system, such as the location and number of light fixtures and discharge nozzles. Once this is accomplished, any musical piece can serve as the stimulus for the fountain control program. In many of the prior art systems, the fountain control program would need to be customized for each musical piece. Obviously, this results in limiting the flexibility of the system in relation to the money available for customized programming.

As can be appreciated, the programmable logic controller can be use to control other aspects of the presentation. For example, the audio program can be selected and controlled using the programmable logic controller. A wind speed indicator could also be connected to the programmable logic controller, which would allow the height of the water stream to be lowered or stopped in adverse weather conditions.

While the invention has been described with respect to a single preferred embodiment, it will be appreciated that many other variations, modifications, and applications will be apparent to one skilled in the art and are intended to fall within the scope of the following claims.

That which is claimed is:

1. A fountain control system comprising:

a fountain controller having an audio input, a plurality of motor drive controllers, and a means for programming said fountain controller;

a plurality of motor drives, each of said motor drives receiving a control signal from said motor drive controller of the fountain controller;

a plurality of water pumps, each of said water pumps being connected to a water reservoir and at least one water discharge conduit, each of said water pumps having means for pumping water from the water reservoir to the water discharge conduit, said means for pumping having a variable speed, each of said water pumps being controlled by one of said plurality of motor drives such that the output of the means for pumping can be varied, each water discharge conduit terminating in a water discharge outlet whereby a stream of water can be projected into the air;

a source of audio signals, said signals being received by the audio input of the fountain controller, said motor drive controller being controlled by the fountain controller in accordance with the audio signals to produce a unique visual display; and, at least one audio output speaker.

2. A fountain control system as defined in claim 1, wherein the speed of the means for pumping be infinitely varied.

3. A fountain control system as defined in claim 1, wherein the means for programming the fountain controller is independent of the audio signals being received, thereby eliminating the need to customize the programming of the fountain controller for each unique presentation of audio signals.

4. A fountain control system as defined in claim 3, wherein the means for programming the fountain controller is not changed to produce unique visual displays.

5. A fountain control system as defined in claim 1, wherein said fountain controller further includes at least one light relay controller and the fountain control system is further comprised of a light relay panel, said relay panel receiving a control signal from said light relay controller of the fountain controller thereby controlling the individual intensity of a plurality of lights.

6. A fountain control system as defined in claim 1, wherein each discharge outlet is located remotely from its corresponding water pump.

7. A fountain control system as defined in claim 6, wherein each discharge outlet is a nozzle.

8. A method for controlling a fountain control system comprising the steps of: receiving an analog audio signal through an audio input of a fountain controller;

separating the analog signal into a plurality of analog frequency band signals;

delaying the analog frequency band signals received by an audio output speaker with respect to the analog frequency band signals received by one or more motor drive controllers of the fountain controller, thereby compensating for known mechanical delays;

converting the analog frequency band signals into digital signals for processing by a micro controller device;

processing the digital signals in accordance with a microcontroller program to produce a plurality of control signals; and using the control signals to control aspects of a fountain system presentation.

9. A method for controlling a fountain control system as described in claim 8, wherein the delay is between about 0 milliseconds and 600 milliseconds.

10. A fountain control system comprising:

a fountain controller having an audio input, a plurality of motor drive controllers, and a means for programming said fountain controller;

a plurality of motor drives, each of said motor drives receiving a control signal from said motor drive controller of the fountain controller;

a plurality of water pumps, each of said water pumps being connected to a water reservoir and at least one water discharge conduit, each of said water pumps having means for pumping water from the water reservoir to the water discharge conduit, said pumping means having a variable speed, each of said water pumps being controlled by one of said plurality of motor drives such that the output of the means for pumping can be varied, each water discharge conduit terminating in a water discharge outlet whereby a stream of water can be projected into the air;

a light relay controller;

a source of audio signals, said signals being received by the audio input of the fountain controller, said motor drive controller and said light relay controller being controlled by the fountain controller in accordance with the audio signals to produce a unique visual display; and, at least one audio output speaker.

11. A fountain control system as defined in claim 10, wherein the speed of the means for pumping be infinitely varied.

12. Fountain control system as defined in claim 10, wherein the meaning for programming the fountain controller is independent of the audio signals being received, thereby eliminating the need to customize the programming of the fountain controller for each unique presentation of audio signals.

13. A fountain control system as defined in claim 12 , wherein the means for programming the fountain controller is not changed to produce unique visual displays.

14. A fountain control system as defined in claim 10, wherein the fountain control system is further comprised of a light relay panel, said relay panel receiving a control signal from said light relay controller of the fountain controller thereby controlling the individual intensity of a plurality of lights.

15. A fountain control system as defined in claim 10, wherein each discharge outlet is located remotely from its corresponding water pump.

16. A fountain control system as defined in claim 15, wherein each discharge outlet is a nozzle.

* * * * *